US009468238B2

(12) United States Patent
Keathley

(10) Patent No.: US 9,468,238 B2
(45) Date of Patent: Oct. 18, 2016

(54) SPORTMANS GARMENT WITH TORSO ADJUSTMENT

(71) Applicant: Robert Keathley, Catonsville, MD (US)

(72) Inventor: Robert Keathley, Catonsville, MD (US)

(73) Assignee: Under Armour, Inc., Baltimore, MD (US)

( * ) Notice: Subject to any disclaimer, the term of this patent is extended or adjusted under 35 U.S.C. 154(b) by 149 days.

(21) Appl. No.: 14/448,661

(22) Filed: Jul. 31, 2014

(65) Prior Publication Data

US 2014/0338094 A1 Nov. 20, 2014

Related U.S. Application Data

(62) Division of application No. 13/484,906, filed on May 31, 2012, now Pat. No. 9,226,531.

(51) Int. Cl.

| | |
|---|---|
| ***A41D 1/02*** | (2006.01) |
| ***A41D 13/00*** | (2006.01) |
| *A41D 27/10* | (2006.01) |
| *A41D 3/00* | (2006.01) |

(52) U.S. Cl.

CPC ..... *A41D 1/02* (2013.01); *A41D 13/0007* (2013.01); *A41D 13/0015* (2013.01); *A41D 3/00* (2013.01); *A41D 27/10* (2013.01); *A41D 2400/38* (2013.01); *A41D 2600/108* (2013.01)

(58) Field of Classification Search

CPC ..... A41D 13/0007; A41D 13/0015; A41D 13/0012; A41D 2600/108; A41D 2400/38; A41D 2400/44; A41D 3/00; A41D 3/02; A41D 1/02; A41D 2300/33; A41D 27/00; A41D 15/002

USPC ..... 2/94, 85, 93, 97, 101

See application file for complete search history.

(56) References Cited

U.S. PATENT DOCUMENTS

| | | | | |
|---|---|---|---|---|
| 187,405 | A | 2/1877 | Moulton | |
| 222,262 | A | 12/1879 | Felt | |
| 359,330 | A | 3/1887 | Smadbeok | |
| 1,061,686 | A | 5/1913 | Niohols | |
| 2,113,911 | A * | 4/1938 | Bjornson | 2/93 |
| 2,398,258 | A | 4/1946 | Seegal | |
| 2,470,031 | A | 5/1949 | Harris | |
| 2,719,981 | A | 10/1955 | Walter | |
| 2,897,508 | A | 8/1959 | Bashore et al. | |
| 3,074,074 | A | 1/1963 | Lovering | |

(Continued)

FOREIGN PATENT DOCUMENTS

| | | | |
|---|---|---|---|
| JP | 2001303335 | A | 10/2001 |
| JP | 2009024273 | A | 2/2009 |

*Primary Examiner* — Andrew W Collins

(74) *Attorney, Agent, or Firm* — Maginot, Moore & Beck LLP

(57) ABSTRACT

A garment comprises a torso portion including a volume reduction arrangement. The volume reduction arrangement includes a first strap that crosses a second strap, a first strap adjustment member, and a second strap adjustment member. The first strap adjustment member is coupled to a right side of the torso portion. A first portion of the first strap is coupled to a left side of the torso portion, and a second portion of the first strap engages the first strap adjustment member on the right side of the torso portion. The second strap adjustment member is coupled to the shell on the left side of the torso portion. A first portion of the second strap is coupled to the right side of the torso portion, and a second portion of the second strap engages the second strap adjustment member on the left side of the torso portion.

20 Claims, 9 Drawing Sheets

(56) References Cited

U.S. PATENT DOCUMENTS

| | | | | |
|---|---|---|---|---|
| D228,828 | S | 10/1973 | Chapman | |
| 3,857,125 | A | 12/1974 | Hunt | |
| 4,164,792 | A | 8/1979 | Ito | |
| 4,177,877 | A * | 12/1979 | Gallinati | 182/3 |
| 4,682,671 | A | 7/1987 | Hengstenberger et al. | |
| 4,731,882 | A | 3/1988 | Ekman | |
| 4,864,695 | A | 9/1989 | Gold | |
| 4,944,042 | A | 7/1990 | DeWan | |
| 5,263,202 | A | 11/1993 | Siberell | |
| 5,533,210 | A | 7/1996 | Maderek et al. | |
| D379,110 | S | 5/1997 | Neustater et al. | |
| 5,946,724 | A | 9/1999 | Erickson | |
| 6,018,830 | A | 2/2000 | Howe | |
| 6,035,440 | A | 3/2000 | Woodyard | |
| 6,101,631 | A | 8/2000 | Ferguson, Jr. | |
| 6,185,743 | B1 | 2/2001 | Mick | |
| 6,256,789 | B1 | 7/2001 | Young et al. | |
| RE37,394 | E | 10/2001 | Woodyard | |
| 6,305,024 | B1 | 10/2001 | Schweer | |
| 6,317,894 | B1 | 11/2001 | Blechman | |
| 6,618,863 | B2 | 9/2003 | Blechman | |
| 6,637,547 | B1 | 10/2003 | Wydner | |
| 6,658,666 | B2 | 12/2003 | Schweer | |
| 6,668,386 | B2 | 12/2003 | Vidal | |
| 6,698,026 | B2 | 3/2004 | Schweer | |
| 6,892,395 | B2 | 5/2005 | Schweer | |
| 7,171,695 | B2 | 2/2007 | Braun | |
| 7,254,871 | B2 | 8/2007 | Yoshiguchi | |
| 7,344,308 | B2 | 3/2008 | Meyer et al. | |
| 7,360,282 | B2 | 4/2008 | Borsoi | |
| 7,412,728 | B2 | 8/2008 | Alesina et al. | |
| 7,451,495 | B2 | 11/2008 | Munn et al. | |
| 7,921,470 | B2 | 4/2011 | Doran | |
| 8,002,082 | B2 | 8/2011 | Snedeker | |
| 8,707,465 | B2 * | 4/2014 | Reynolds | 2/102 |
| 2002/0029407 | A1 * | 3/2002 | Blechman | 2/311 |
| 2004/0158910 | A1 | 8/2004 | Bay | |
| 2004/0237168 | A1 * | 12/2004 | Braun | 2/93 |
| 2006/0131105 | A1 | 6/2006 | Brown, Jr. | |
| 2008/0066272 | A1 | 3/2008 | Hammerslag et al. | |
| 2009/0044309 | A1 | 2/2009 | Yarbrough et al. | |
| 2010/0306901 | A1 | 12/2010 | Erickson | |
| 2011/0225843 | A1 | 9/2011 | Kerns et al. | |
| 2011/0266384 | A1 | 11/2011 | Goodman et al. | |

* cited by examiner

SPORTMANS GARMENT WITH TORSO ADJUSTMENT

CROSS-REFERENCE TO RELATED APPLICATIONS

This application is a divisional of U.S. patent application Ser. No. 13/484,906, filed May 31, 2012.

FIELD

This application relates to the field of garments, and particularly to jackets and upper body garments worn by hunters and other outdoorsmen.

BACKGROUND

Jackets fit humans differently depending on their body type. Varying amounts of excess, loosely fitting fabric will result in different locations on the jacket depending on the body shape of the wearer. When a relatively thin man wears a jacket of a given size, a significant amount of excess fabric may exist around the waist. On the other hand, when a relatively heavy man wears the same jacket, little excess fabric may exist around the waist.

In addition to body type, the fit of a jacket also depends on the number of layers of clothing and the bulk of such clothing worn under the jacket. Thus, for a single person, varying amounts of excess, loosely fitting fabric will result in different locations on the jacket depending on the clothes worn under the jacket. When the jacket is worn in relatively cold weather with several layers of bulky clothing under the jacket, little loose fabric will be present. On the other hand, when the jacket is worn in relatively warm weather with few layers of clothing under the jacket, such as only a T-shirt, excess fabric will be present on the outer layer of the jacket. In these situations, the excess fabric tends to fit loosely on the wearer and fan out from the body of the wearer in a bulky manner.

For many outdoor activities excessive, loosely fitting fabric on a jacket is not problematic. For example, when the wearer is only on a walk, there is no problem with excessive fabric around the waist and arms of the wearer. However, for other outdoor activities, excess fabric can be problematic. For example, a hunter may experience difficulty shooting a weapon with excess fabric around the arm sleeves or waist area that tends to flare outward from the body and produce bulk. This excess fabric may not only interfere with sight lines, but may also affect the firing of the weapon, such as when the excess fabric on a jacket sleeve comes into contact with a bow string. As another example, excess fabric in the jacket sleeve or waist area may interfere with the free movement of the arms of a golfer swinging a golf club.

Hunters and other outdoorsmen have conventionally used various means to reduce the bulk of excess fabric on a jacket. For example, some bow hunters carry an arm guard with straps or a compression sleeve that is configured to fit over the arm of the jacket and compress excess fabric against the arm of the wearer. However, these items are inconvenient to carry and may be easily forgotten or lost. In addition, even when a hunter remembers to carry an arm guard on his or her person, the arm guard is typically not conveniently located and capable of use on short notice. Instead, the hunter must typically retrieve the arm guard from a carrying bag and insert it over the jacket arm in order to reduce the bulk of excess fabric on the jacket arm. This process not only takes a significant amount of time, but is typically accomplished without assistance from another person.

In view of the foregoing, it would be advantageous to provide a jacket that may be worn without interfering with outdoor sporting activities such as hunting or golf. It would be further advantageous if such jacket were adaptable to be worn by individuals of different body types. Furthermore, it would be advantageous if such jacket were configured to allow a wearer to reduce the bulk excess fabric in one or more locations on the jacket without the need for assistance by another person. Additionally, it would be advantageous if such jacket could be used in association with other equipment such as a hunting harness.

SUMMARY

In accordance with one embodiment of the disclosure, a garment configured to be worn by a human comprises a torso portion including a shell with an inner side and an outer side. A volume reduction arrangement is provided on the torso portion. The volume reduction arrangement includes a first strap, a second strap, a first strap adjustment member, and a second strap adjustment member. The first strap adjustment member is coupled to the shell on a right side of the torso portion. A first portion of the first strap is coupled to the inner side of the shell on a left side of the torso portion, and a second portion of the first strap engages the first strap adjustment member on the right side of the torso portion. The second strap adjustment member is coupled to the shell on the left side of the torso portion. A first portion of the second strap is coupled to the inner side of the shell on the right side of the torso portion, and a second portion of the second strap engages the second strap adjustment member on the left side of the torso portion. The first strap crosses the second strap on a posterior of the shell.

Pursuant to another embodiment of the disclosure, a hunting jacket configured to be worn by a hunter includes a torso portion having an inner side and an outer side, and a volume reduction arrangement provided on the torso portion. The volume reduction arrangement includes a first strap, a second strap, a first strap adjustment member and a second strap adjustment member. A first portion of the first strap is coupled to a left side of the torso portion. A first portion of the second strap is coupled to a right side of the torso portion. The first strap crosses the second strap at a posterior of the torso portion. A first strap adjustment member is coupled to the right side of the torso portion with a second portion of the first strap engaging the first strap adjustment member on the right side of the torso portion. A second strap adjustment member is coupled to the left side of the torso portion with a second portion of the second strap engaging the second strap adjustment member on the left side of the torso portion.

In accordance with another embodiment of the disclosure, there is provided a garment configured to be worn on the upper body of a human. The garment comprises a torso portion and a sleeve extending from the torso portion. The sleeve includes a shoulder end coupled to the torso portion, a wrist end opposite the shoulder end, a forearm portion closer to the wrist end than the shoulder end, and an upper arm portion closer to the shoulder end than the wrist end. The garment further comprises a volume reduction arrangement provided on the forearm portion of the sleeve. The volume reduction arrangement includes a strap and a strap adjustment member. A first portion of the strap is coupled to the forearm portion, a second portion of the strap engages the strap adjustment member, and the strap adjustment member is coupled to the forearm portion.

In accordance with yet another embodiment of the disclosure, there is provided a hunting jacket configured to be worn by a hunter with a harness. The hunting jacket comprises a torso portion including an anterior side and a posterior side, most of an exterior of the torso portion having a bright, highly visible color scheme or a camouflaged color scheme. The hunting jacket further comprises a harness passage extending from an interior of the torso portion to the exterior of the torso portion. The harness passage includes a proximal end connected to the posterior side and a distal end that is pivotable about the proximal end of the harness passage. The harness passage provides a channel configured to receive a harness strap extending from the proximal end to the distal end of the harness passage.

The above described features and advantages, as well as others, will become more readily apparent to those of ordinary skill in the art by reference to the following detailed description and accompanying drawings. While it would be desirable to provide a garment that provides one or more of these or other advantageous features, the teachings disclosed herein extend to those embodiments which fall within the scope of the appended claims, regardless of whether they accomplish one or more of the above-mentioned advantages.

BRIEF DESCRIPTION OF THE DRAWINGS

FIG. 4A is an exploded view of the first volume reduction arrangement of

FIG. 1;

DESCRIPTION

Figure 1:
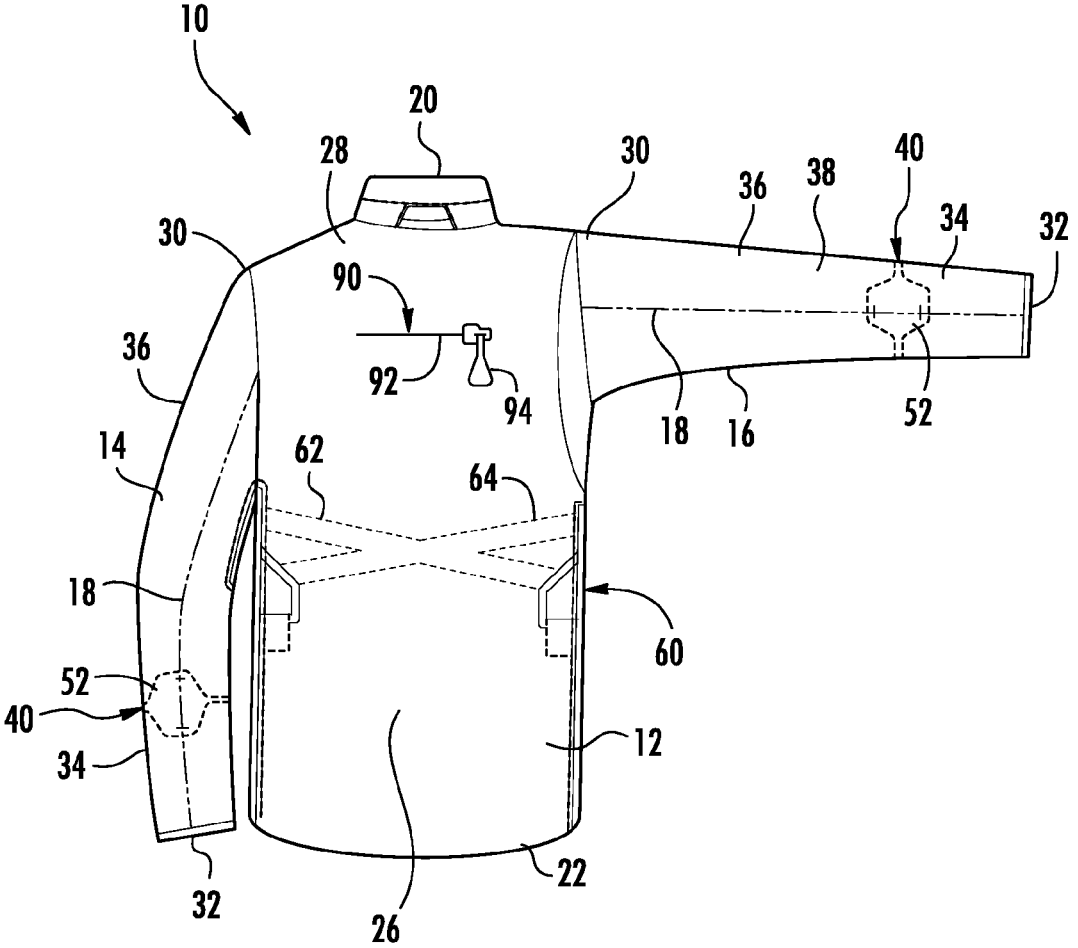
FIG. 1 is a posterior view of a garment including a first volume reduction arrangement on a forearm portion of a sleeve of the garment, a second volume reduction arrangement on the back of a torso portion of the garment, and a harness passage.
Figure 2:
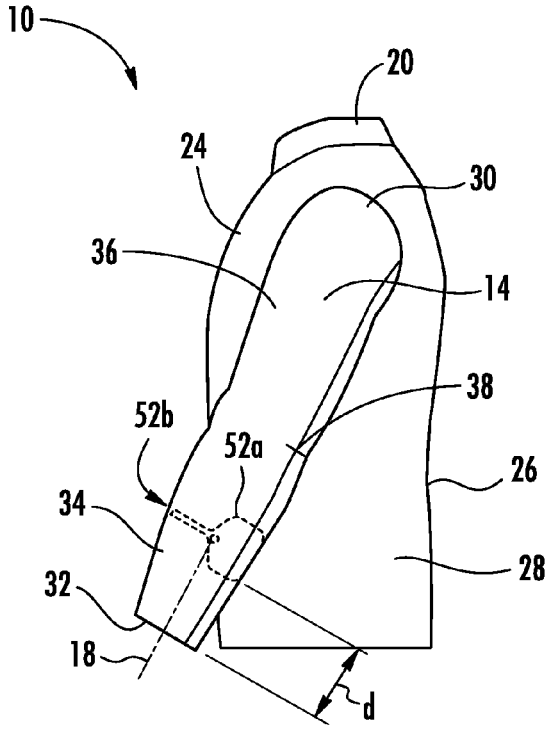
FIG. 2 is a left side view of the garment of FIG. 1.
Figure 3:
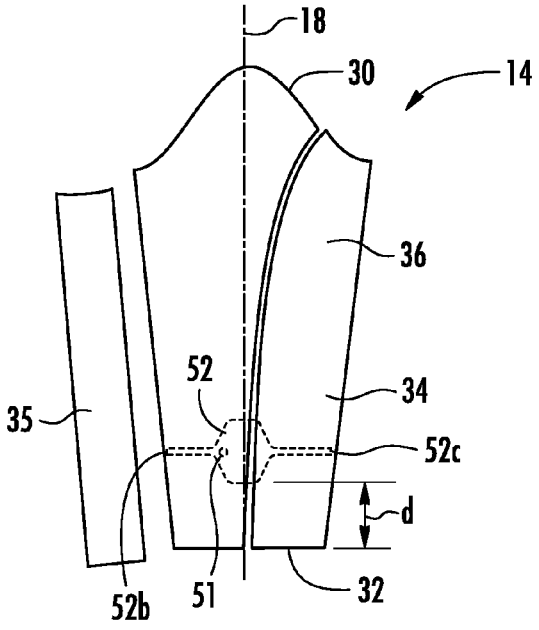
FIG. 3 is a plan view of panels of the sleeve of FIG. 2.

With reference to FIGS. 1-3, a garment 10 includes a torso portion 12 with two sleeves 14, 16 extending from the torso portion 12. One volume reduction arrangement 40 is provided on each sleeve 14, 16. Another volume reduction arrangement 60 is provided on the torso portion 12. The volume reduction arrangements 40, 60 are each configured to urge excess material on the garment toward the body of the wearer. The volume reduction 40 arrangement is positioned on the sleeve and configured to urge excess material on the garment toward the arm of the wearer. The volume reduction arrangement 60 is provided on the posterior of the torso portion 12 and is configured to urge excess material on the garment toward the back of the wearer. A harness passage 90 is also provided on the posterior of the torso portion 12. The harness passage 90 is configured to pass a harness strap (not shown in FIG. 1) through the torso portion such that a harness worn under the garment may be attached to a secure location without interfering with the garment.

The upper body garment 10 is shown in FIGS. 1-3 in the form of a jacket configured to be worn by a human. However, it will be recognized that in other embodiments, the upper body garment 10 may be provided in other forms, including shirts, vests, coats, ponchos, etc. in any of various forms and configurations as will be recognized by those of ordinary skill in the art. Accordingly, the garment 10 may be comprised of any of various fabrics and materials including, for example, cotton, polyester, wool, leather, plastic, elastane or other fabrics and materials. Fabrics on the garment 10 may be any of various types of fabrics including, for example, knitted, woven, non-woven or other types of fabrics. Additionally, the garment 10 may include various layers of material or fabric at various locations on the garment. For example, the garment may include an outer layer with a durable water-repellent finish, an inner layer comprised of a polyester or cotton material that is comfortable against the skin of the wearer, and a layer of insulation material between the outer layer and inner layer.

In the embodiment of FIGS. 1-3, the torso portion 12 of the garment 10 includes a neck 20 defining an upper opening, and a waist 22 defining a lower opening to the torso portion 12. The torso portion 12 further includes a front side 24 and a back side 26. The garment of FIGS. 1-3 includes a plurality of layers, including an outer layer shell 28, and an inner layer (not shown) comprised of a comfort fabric material. Insulative material, such as a down or fleece material, is provided between the inner layer and the shell 28. The term "shell" as used herein simply refers to the outer layer of the garment 10. A "shell" may or may not include rigid or hard materials. Accordingly, the term "shell" as used herein may refer to a soft pliable polyester fabric outer layer, a relatively rigid plastic portion of the outer layer, or some combination thereof. In at least one embodiment where the garment is used for hunting, the shell has a bright highly visible color scheme or a camouflaged color scheme.

Each sleeve 14, 16 of the garment includes a shoulder end 30 coupled to the torso portion 12 and a wrist end 32 opposite the shoulder end 30. A forearm portion 34 of the sleeve 14, 16 is provided closer to the wrist end 32 than the shoulder end 30. An upper arm portion 36 of the sleeve 14, 16 is provided closer to the shoulder end 30 than the wrist end 32. An elbow portion 38 of the sleeve separates the forearm portion 34 from the upper arm portion 36.

Sleeve Volume Reduction Arrangement

With reference now to FIGS. 2-4C in addition to FIG. 1, the volume reduction arrangement 40 (which may be referred to herein as the "sleeve volume reduction arrangement") is provided on the forearm portion 34 of each sleeve 14, 16. The sleeve volume reduction arrangement 40 is configured to pull, draw or otherwise urge excess material (i.e., loosely fitting material) on the garment toward the body of wearer. While the sleeve volume reduction arrangement 40 is described in the following paragraphs as being positioned on the left sleeve 14, it will be appreciated that an additional sleeve volume reduction arrangement 40 may also be provided on the right sleeve 16.

Figure 4A:
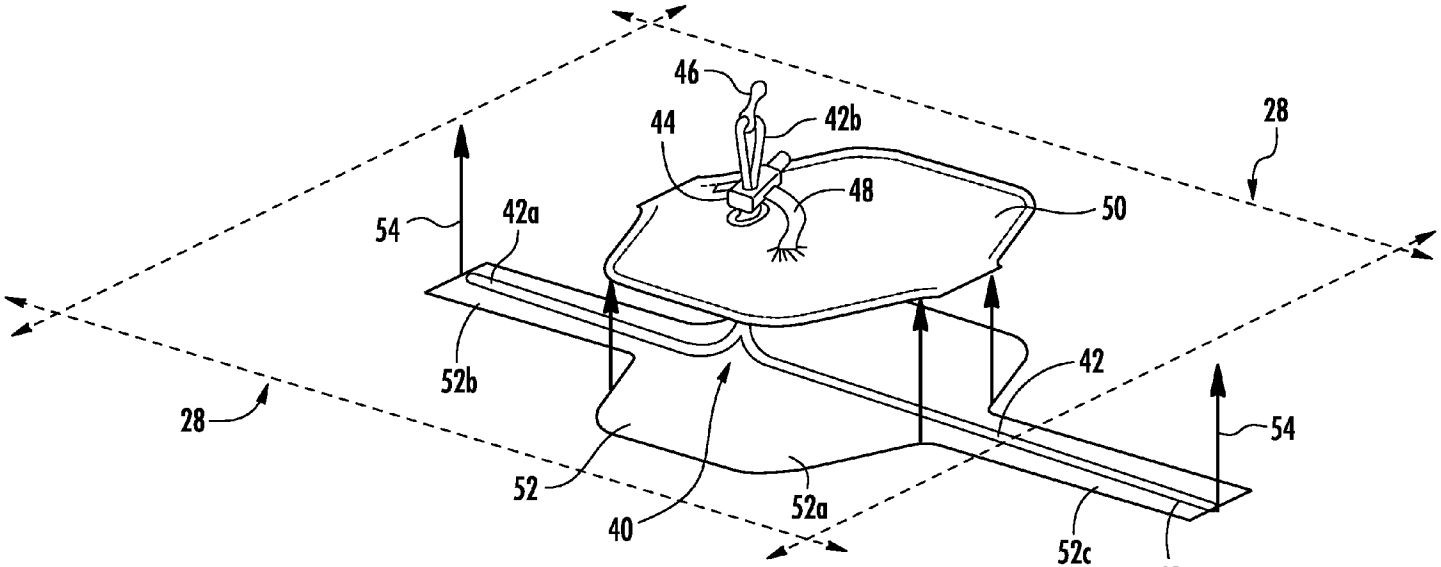

As best shown in FIG. 4A, the sleeve volume reduction arrangement 40 includes a strap in the form of a shock cord 42 and a strap adjustment member in the form of a cord lock 44. The shock cord 42 is a generally elastic cord, as will be recognized by those of ordinary skill in the art, and includes two end portions 42*a* and 42*c*, and a central portion 42*b*. Although a strap in the form of a shock cord 42 is disclosed herein, it will be recognized that the strap could also be provided in other forms such as an inelastic cord or belt, a semi-rigid cable, a wire, or other form of a strap. In the embodiment disclosed herein, the two end portions 42*a*, 42*c* of the shock cord 42 are attached to an inner surface of the shell 28 on the forearm portion 34 of the garment 10. The central portion 42*b* of the shock cord 42 engages the cord lock 44. The cord lock 44 is also attached to the forearm portion 34 of the garment 10 by a tether 48.

In at least one embodiment, the cord lock 44 includes a barrel, a toggle and a spring, as will be recognized by those of ordinary skill in the art, and the central portion 42*b* of the shock cord 42 extends through a passage in the barrel and the toggle. The central portion 42*b* of the shock cord 42 forms a loop on one side of the cord lock 44, allowing a user to place his or her finger in the loop and pull on the shock cord further through the passage such that the size of the loop in the central portion 42*b* increases. When the user presses the barrel of the cord lock 44, the openings in the passage are aligned, and the shock cord 42 moves in the opposite direction through the passage of the cord lock 44 such that the size of the loop in the central portion 42*b* decreases. A tab member 46 may be attached to the loop on the central portion 42*b* of the shock cord 42 to prevent the loop from passing completely through the passage of the cord lock 44. The tether 48 is coupled to the barrel of the cord lock 44. The tether 48 is generally less than two inches in length, and particularly about one inch in length in at least one embodiment. The tether 48 attaches the cord lock 44 to the forearm portion 34 of the garment 10, while also allowing a slight amount of movement of the cord lock 44. As a result, the cord lock 44 remains in close proximity to the garment when the user pulls on the cord 42, allowing the cord to be pulled further through the passage of the cord lock.

With continued reference to FIG. 4A, the shock cord 42 and cord lock 44 of the sleeve volume reduction arrangement 40 are located within a pocket on the forearm portion 34 of the sleeve 14. The pocket is provided within a three layer structure that includes the shell 28 (shown in dotted lines in FIG. 4A), an intermediate layer 50, and an inner layer 52. The intermediate layer 50 and the inner layer 52 are both sewn or otherwise attached to the inner side of the shell 28, as represented by arrows 54.

Figure 4C:
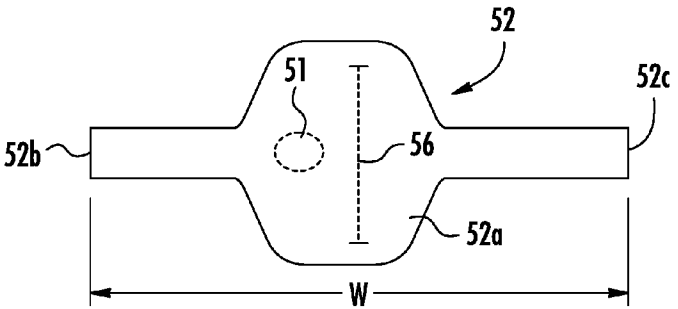
FIG. 4C is a plan view of an inner layer of the first volume reduction arrangement of FIG. 4A.
Figure 4B:
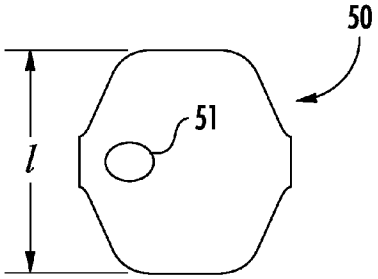
FIG. 4B is a plan view of an intermediate layer of the first volume reduction arrangement of FIG. 4A.

As best shown in FIG. 4B, the intermediate layer 50 has a generally octagonal shape with a length l separating opposing sides of the intermediate layer 50. In at least one embodiment, the length l is between two and five inches, and particularly about 3.5 inches. The intermediate layer includes a hole 51 that is slightly offset from the center. As best shown in FIG. 4A, the hole 51 is designed and dimensioned to pass the central portion 42*b* of the shock cord 42 such that two stretches of the shock cord 42 extend through the hole 51, allowing the shock cord to form a loop at the central portion 42*b*. The perimeter of the hole 51 may be reinforced with stitching or a grommet to prevent the intermediate layer 50 from tearing at the hole 51 as the shock cord 42 is stretched through the hole 51. While the intermediate layer has been described herein as having a generally octagonal shape in at least one embodiment, it will be recognized that different embodiments of the intermediate layer make take on different shapes, such as circular or rectangular shapes.

With reference now to FIG. 4C, the inner layer 52 includes an enlarged central member 52*a* and two elongated wings 52*b* and 52*c* extending away from an enlarged central member 52*a*. The enlarged central member 52*a* is the same size and shape as the intermediate layer 50 and the perimeter of the enlarged central member 52*a* is aligned with the perimeter of the intermediate layer on the forearm portion 34 of the garment 10. While the enlarged central member 52*a* of the inner layer 52 does not include a hole 51, the hole 51 is represented in FIG. 4C in dotted lines to show the position of the hole 51 relative to the inner layer 52 when the intermediate layer 50 is attached to the inner layer 52.

As shown in FIG. 4C, the wings 52*b* and 52*c* of the inner layer 52 extend outward from opposite sides of the enlarged central member 52*a* of the inner layer 52. The tips of the wings are separated by a wingspan distance w. In at least one embodiment, the wingspan distance w is greater than seven inches and less than ten inches, and particularly about 8.5 inches. The shock cord 42 is slightly greater in length than the wingspan distance w in an un-stretched state to allow for the loop on the central portion 42*b*. When the inner layer 52 and the intermediate layer 50 are attached to the inner side of the shell 28, the cord 42 is generally positioned between the inner layer 52 and the shell 28. Some length of the cord 42 is retained between the intermediate layer 50 and the inner layer 52, while the central portion 42*b* of the cord 42 extends through the hole 51 in the intermediate layer where it can be accessed by a wearer within the pocket.

In order to provide access to the cord 42, the shell 28 includes an opening 56 on the forearm portion 34 that extends from the outer side to the inner side of the shell 28. This opening 56 provides access to the pocket containing the sleeve volume reduction arrangement 40, and particularly the central portion 42*b* of the cord 42 and the associated cord lock 44. The position of this opening 56 relative to the intermediate layer 50 and the inner layer 52 is illustrated in FIG. 4C with a dotted line. The opening is generally large enough to allow a user to insert his or her fingers into the pocket and hook onto the loop provided at the central portion 42*b* of the shock cord 42.

The placement of the intermediate layer 50 and the inner layer 52 on the inner side of the forearm portion 34 of the shell 28 is illustrated in FIGS. 1-3 by dotted lines. The wings 52*b* and 52*c* extend in a generally circular manner from the enlarged central member 52*a* about a central axis 18 of the sleeve 14. The enlarged central member 52*a* is positioned on a posterior side of the sleeve 14, and extends over an area that corresponds to a region of the extensor digitorum of the wearer (i.e., a region on the backhand side of the middle forearm of the wearer) or the flexor carpi ulnaris. The enlarged central member is separated from the wrist end 32 of the sleeve 14 by a distance d, as shown in FIGS. 2 and 3. In at least one embodiment, the distance d is about three to seven inches. In at least one embodiment, the distance d is about five inches in length. As shown in FIG. 3 the sleeve includes an anterior portion 35 that that is not traversed by the inner layer 52. Accordingly, the wingspan w of the inner layer 52 does not extend completely around the sleeve 14 and the shock cord 42 does not engage the anterior portion 35 of the sleeve 14. However, it will be recognized that the wingspan w of the inner layer could extend completely around the sleeve 14 in other embodiments.

Figure 5:
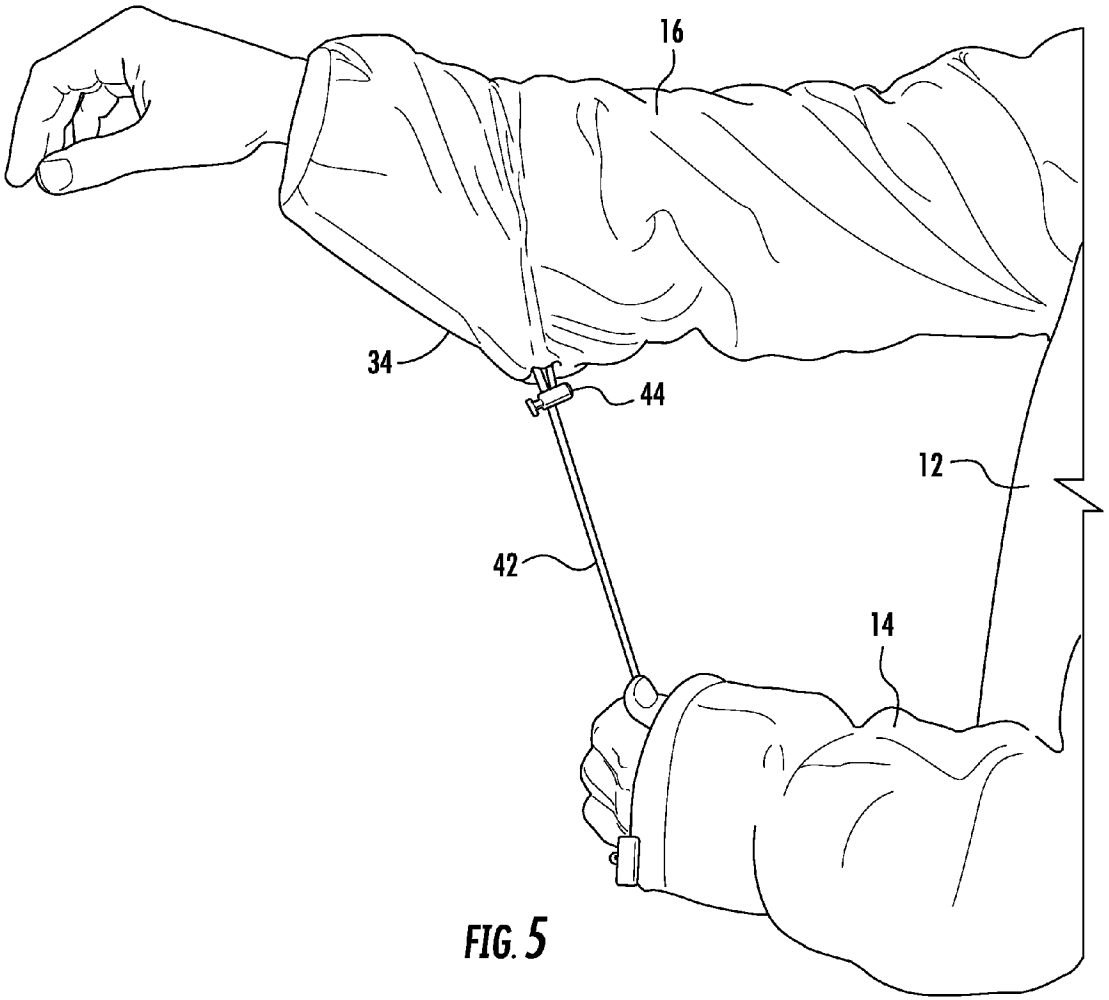
FIG. 5 shows the first volume reduction arrangement of FIG. 1 being pulled by a wearer to a volume stretched state.

In operation, a wearer may don the garment 10 with the sleeve volume reduction arrangements 40 in a relaxed state such that excess fabric on the garment is not drawn into the body of the wearer. At a time when the wearer wishes to gather excess fabric on the garment 10 into his or her forearm, the wearer inserts his or her finger into the pocket of the sleeve volume reduction arrangement 40 and through the loop formed on the central portion 42*b* of the cord 42. When the wearer pulls on this cord 42, as illustrated in FIG. 5, the cord 42 moves through the passage of the cord lock 44 while the cord lock 44 remains tethered to the forearm portion 34 of the garment 10. This stretches parts of the cord 42 between the end portions 42*a*, 42*c* and the cord lock 44, drawing the anterior portion 35 of the sleeve more closely into the arm of the wearer, and drawing excess fabric on the forearm portion 34 toward the posterior of the sleeve 14. As a result, the wearer is strategically provided with a garment where fabric may be drawn more tightly into the body in the targeted area of the forearm, and the excess fabric in this targeted area is managed at the discretion of the user. The wearer may release the added tension on the cord 42 at his or her discretion by depressing the toggle on the cord lock 44, allowing the cord to return to a more relaxed state.

Torso Volume Reduction Arrangement

In addition to the sleeve volume reduction arrangement 40 provided on one or more of the sleeves 14, 16 a torso volume reduction arrangement 60 is also provided on the back of the garment 10. In the embodiment of FIG. 1, the torso volume reduction arrangement 60 extends across a middle portion of the back of the wearer. This torso volume reduction arrangement 60 includes straps that extend through crisscrossing passages 62, 64 (represented in dotted lines in FIG. 1) on the back of the garment 10. However, it will be recognized that the torso volume reduction arrangement 60 and the related passages may be provided in different forms in other embodiments.

The torso volume reduction arrangement 60 is similar to the sleeve volume reduction arrangement 40 and includes straps and strap adjustment members that may manipulated by the wearer to urge excess fabric toward the body of the wearer. In addition, the torso volume reduction arrangement 60 also includes several features that are somewhat different from the sleeve volume reduction arrangement 40, as described in more detail the following paragraphs.

Figure 6:
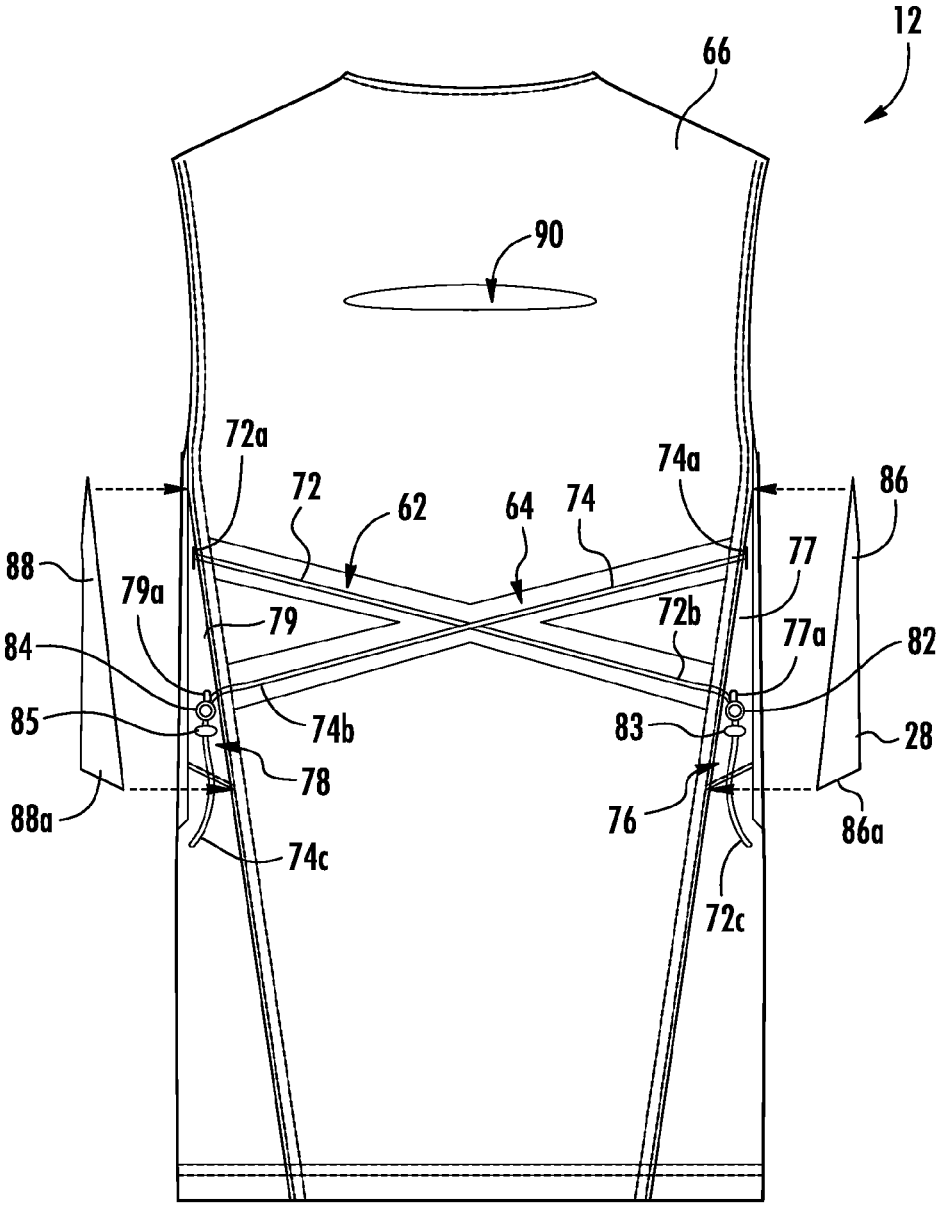
FIG. 6 is a posterior view of an inner liner of the garment of FIG. 1 including components of the second volume reduction arrangement extending across the back of the torso portion of the garment.

FIG. 6 shows the configuration of the torso volume reduction arrangement 60 relative to an inner liner 66 of the torso portion 12 of the garment 10. As shown in FIG. 6, the torso volume reduction arrangement 60 includes a first cord 72 and a second cord 74. The first cord 72 extends through the first passage 62 which is formed between the inner liner 66 and the outer shell 28 on the back portion of the garment 10. The second cord 74 extends through the second passage 64 which is also formed between the inner liner 66 and the outer shell 28 on the back portion of the garment 10. The first passage 62 crisscrosses the second passage 64 near the center of the back portion of the garment 10. Accordingly, the first cord 72 also crisscrosses the second cord 74 near the center of the back portion of the garment 10. The passages 62, 64 generally cover regions on the garment that correspond to various muscle groups on the back of the wearer, such as the terres major, lastissimus dorsi, the erector spinae, the lower trapezius, and the thoracolumbar fascia.

A first end 72*a* of the first cord 72 is sewn or otherwise connected to the inner side of the outer shell 28 near at the upper left side of the passage 62. A portion 72*b* near a second end 72*c* of the first cord 72 extends into a first pocket 76 formed at the lower right side of the passage 62. The tip of the second end 72*c* is positioned completely outside of the first pocket 76.

The first pocket 76 is formed between an intermediate panel 77 attached to the inner liner 66 and an outer panel 86 that is part of the shell 28. The intermediate panel 77 includes a hole 77*a* configured to pass the first cord 72. The hole 77*a* may be reinforced with stitching or a grommet to prevent tearing of the hole as the first cord 72 moves through the hole 77*a*. In the embodiment disclosed herein, the hole 77*a* is positioned about four to twelve inches below the arm hole where the sleeve 16 is connected to the torso portion 12, and particularly about six inches below the arm hole.

An opening to the first pocket 76 is provided on the outer shell 28 along a lower edge 86*a* of the outer panel 86. The opening is sufficiently sized to receive one or more fingers of a human hand. A first cord lock 82 is tethered to the shell 28 within the first pocket 76. In the disclosed embodiment, the tether (not shown) is less than two inches in length. The second end 72*c* of the first cord 72 extends through a passage in the first cord lock 82. Accordingly, the first cord 72 is attached directly to the garment at the first end 72*a* and indirectly attached to the garment at the second portion 72*b* via the first cord lock 82. A stopper 83, such as a plastic tab or a knot, is positioned on the first cord 72 and is configured to prevent the second end 72*c* from passing completely through the first cord lock 82.

With continued reference to FIG. 6, the first end 74*a* of the second cord 74 is sewn or otherwise connected to the inner side of the outer shell 28 near at the upper left side of the passage 64. A portion 74*b* near a second end 74*c* of the second cord 74 extends into a second pocket 78 formed at the lower right side of the passage 62. The second pocket 78 is formed between an intermediate panel 79 attached to the inner liner 66 and an outer panel 88 that is part of the shell 28. The intermediate panel 79 includes a hole 79*a* configured to pass the second cord 74. The hole 79*a* may be reinforced with stitching or a grommet to prevent tearing of the hole as the second cord 74 moves through the hole 79*a*. In the embodiment disclosed herein, the hole 79*a* is positioned about four to twelve inches below the arm hole where the sleeve 14 is connected to the torso portion 12, and particularly about six inches below the arm hole.

An opening to the second pocket 78 is provided on the outer shell 28 along a lower edge 88*a* of the outer panel 86. The opening is sufficiently sized to receive one or more fingers of a human hand. A second cord lock 84 is tethered to the shell 28 within the second pocket 78. In the disclosed embodiment, the tether (not shown) is less than two inches in length. The second end 74*b* of the second cord 74 extends through a passage in the second cord lock 84. Accordingly, the second cord 74 is attached directly to the garment at the first end 74*a* and indirectly attached to the garment at the second portion 74*b* via the second cord lock 84. The second cord lock 84 includes a tab 85 configured to prevent the second end 74*b* from passing completely through the second cord lock 84.

Figure 7:
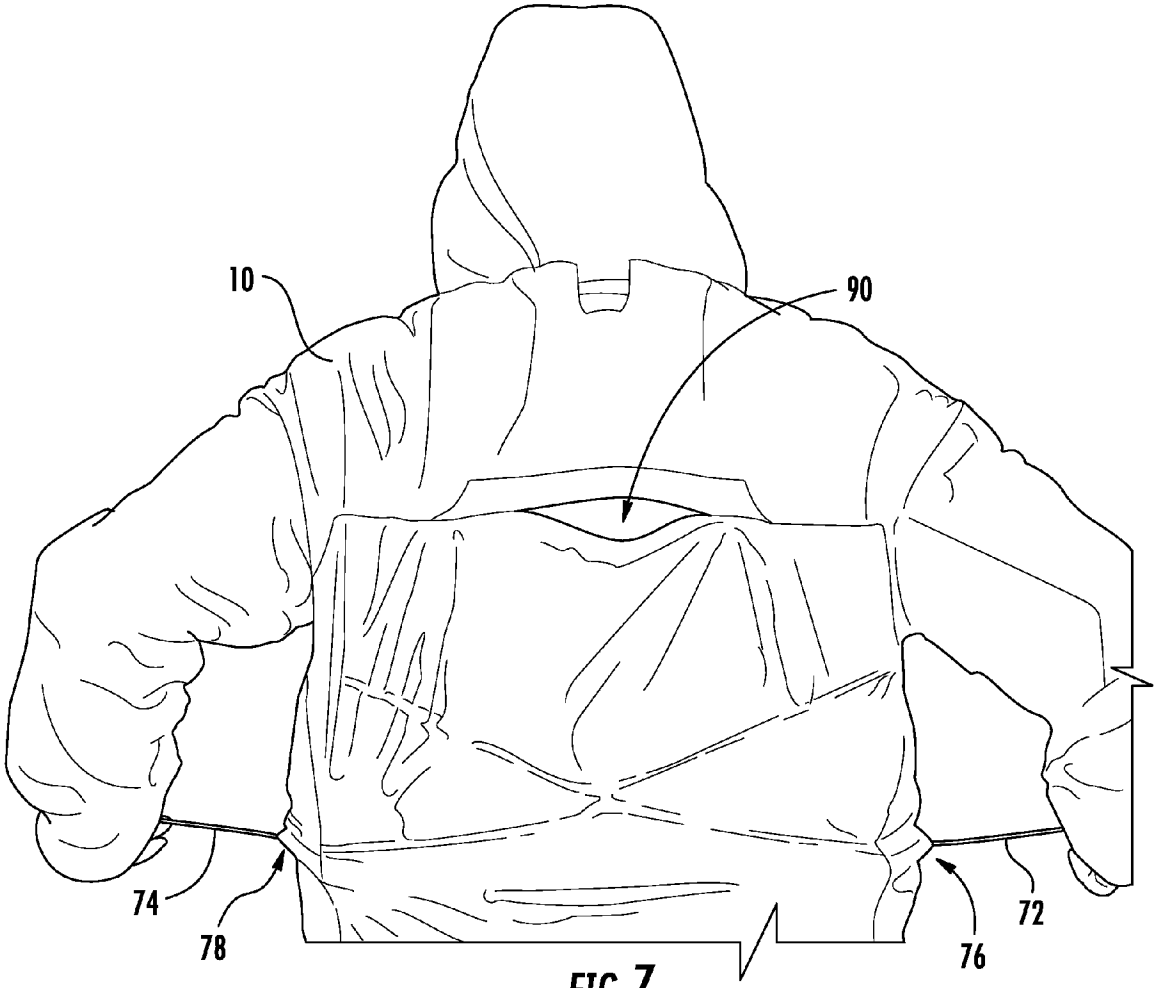
FIG. 7 shows the second volume reduction arrangement of FIG. 1 being pulled by a wearer to a volume stretched state.
Figure 8:
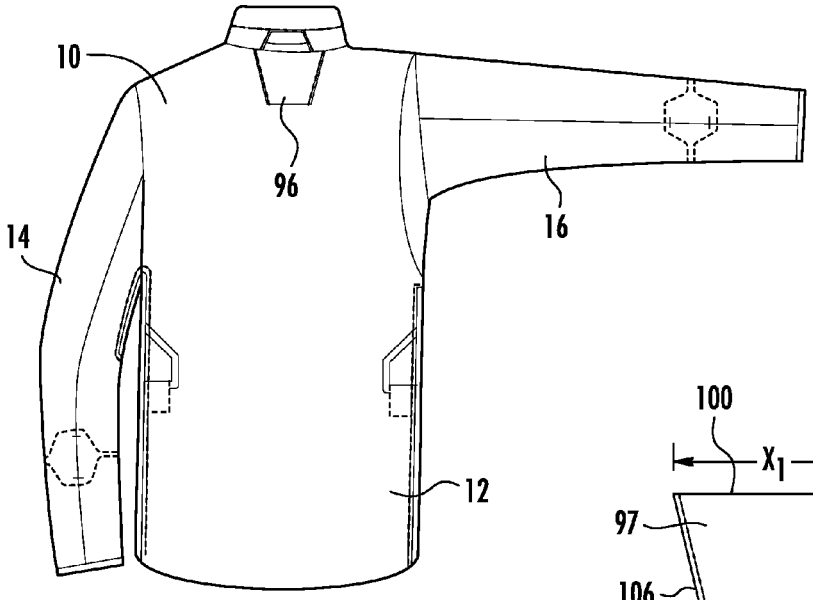
FIG. 8 is an alternative embodiment of the garment of FIG. 1 including a harness passage with a tunnel flap.

In operation, a wearer may don the garment 10 with the arm volume reduction arrangement 60 in a relaxed state such that excess fabric on the garment is not drawn into the body of the wearer. At a time when the wearer wishes to gather excess fabric on the back of the garment 10 into his or her body, the wearer grasps the ends 72*c* and 74*c* of the cords 72 and 74 and pulls the cords 72 and 74 away from his or her body, as illustrated in FIG. 7. When the wearer pulls on the cords 72 and 74, the cords 72 and 74 move through the passage of the cord locks 82 and 84 while the cord locks 82 and 84 remain tethered to the pockets 76 and 78 of the garment 10. This stretches parts of the cords 72 and 74 between the end portions 72*a* and 74*a* and the cord locks 82 and 84, drawing the posterior portion of the shell more closely into the torso of the wearer. At the same time, the stretched cords 72, 74 draw excess fabric on the anterior of the torso portion 12 toward the posterior of the torso portion 12. As a result, the wearer is strategically provided with a garment where fabric may be drawn more tightly into the body in the targeted area of the torso, and the excess fabric in this targeted area is managed at the discretion of the user. The wearer may release the added tension on the cords 72 and 74 at his or her discretion by depressing toggles on the cord locks 82 and 84, and allowing the cords 72 and 74 to return to a more relaxed state.

Harness Passage

With reference now to FIGS. 1 and 6 and 7, the garment includes a harness passage 90 on the upper back portion of the garment 10. The harness passage 90 is configured to provide access to a hunter's safety harness worn on the body of the wearer. The harness passage 90 is particularly configured to allow a harness strap, tether or other safety device to pass through the harness passage 90. It will be recognized that although the harness passage 90 is shown on the upper back portion of the garment 10, the harness passage may also be positioned at other locations on the garment 10.

In the embodiment of FIGS. 1, 6 and 7, the harness passage 90 is provided as a slit that extends in a horizontal direction across the upper back portion of the garment 10, and particularly a region on the garment 10 that corresponds to the trapezius or the serratus posterior superior muscle groups of the wearer. In the embodiment disclosed herein, the slit that provides the harness passage 90 is about three to twelve inches in length in the horizontal direction, and particularly about seven inches in length. The harness passage 90 extends through all the layers of the garment such that an opening is formed in the garment 10 which provides a passage from the interior to the exterior of the garment.

The harness passage 90 is generally configured to be opened or closed by the wearer. In the embodiment of FIGS. 1, 6 and 7, the harness passage 90 includes a zipper 92 with a zipper pull 94. When the zipper pull 94 is moved in one direction, the harness passage 90 is opened. When the zipper pull 94 is moved in the opposite direction, the harness passage 90 is closed. While a zipper 92 has been disclosed herein as the closure for the harness passage 90, it will be recognized by one of ordinary skill in the art that any of various closure devices may be used in association with the harness passage 90, including a hook and loop arrangement, buttons, snaps, etc.

Figure 9:
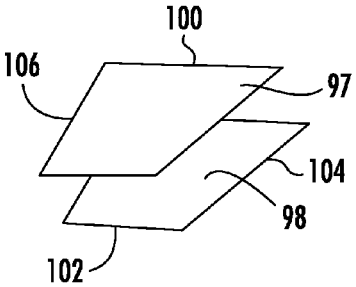
FIG. 9 is an exploded view of the tunnel flap of FIG. 8.

An alternative embodiment of the harness passage 90 is shown in FIGS. 8-12. In this embodiment, the harness passage 90 includes a tunnel flap 96 extending from a posterior side of the garment in a region corresponding to the trapezius muscles of the wearer or the cervical section of the spine of the wearer. As shown in FIG. 9, the tunnel flap 96 includes a first panel 97 and a second panel 98. The first and second panels 97 and 98 are comprised of a flexible material, such as a fabric or plastic material. In at least one embodiment, the panels 97 are comprised of an elastane material treated with a durable water repellant finish.

Figure 10:
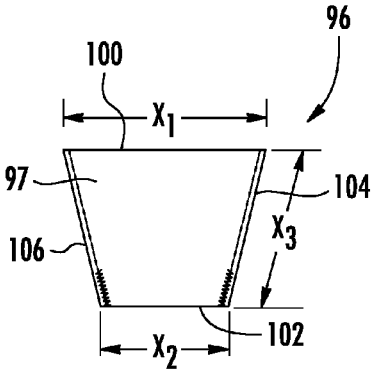
FIG. 10 is a plan view of the tunnel flap of FIG. 8.

As shown in FIGS. 9 and 10, the first and second panels 97 and 98 have a generally trapezoidal shape. However, it will be recognized that the first and second panels 97 and 98 may also be provided in other shapes, such as rectangular or rounded shapes. Each panel 97 and 98 includes a proximal side 100 parallel to a distal side 102, and two non-parallel sides 104, 106. In the disclosed embodiment, the proximal side 100 has a length $x_1$ between two and seven inches, and particularly about 4.75 inches. The distal side 102 has a length $x_2$ between one and six inches, and particularly about three inches. The non-parallel sides 104, 106 each have a length $x_3$ between one-half and five inches, and particularly about 3.85 inches.

The non-parallel sides 104 and 106 of the first and second panels 97 and 98 are sewn or otherwise connected together. However, the proximal sides 100 and the distal sides 102 of the panels 97 and 98 are not connected. As a result, openings are provided at the proximal sides 100 and the distal sides 102 of the tunnel flap 96. The opening at the proximal side 100 feeds into to the opening in the back of the torso portion 12 associated with the harness passage. The tunnel flap is pivotable on the garment 10 about the proximal side 100 (or the proximal end). With this configuration, the harness passage 90 provides a pivotable channel that leads from the exterior to the interior of the garment 10.

Figure 11:
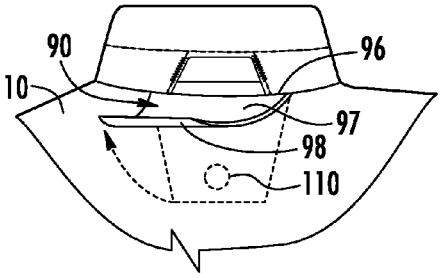
FIG. 11 shows the tunnel flap of FIG. 8 in an upward pivot position.

In at least one embodiment, the tunnel flap 96 includes a first magnetic coupling member 110 connected to the distal side 102 (or distal end) of the second panel 98. The first magnetic coupling member 110 may be a magnet, or a metal member attracted to a magnet. A complimentary second magnetic coupling member (not shown) is connected to the back side of the torso portion 12 at a location where the second magnetic coupling member will magnetically engage the first magnetic coupling member 110 when the tunnel flap is in a downward position (as shown in dotted lines in FIG. 11). This prevents the tunnel flap 96 from moving and disturbing the wearer when not in use. However, when the wearer wishes to use the tunnel flap, the tunnel flap 96 may be easily pulled away from the second magnetic coupling, as shown in FIG. 11. While the magnet coupling member 110 has been disclosed herein as a closure for the tunnel flap 96, it will be recognized that any of various closure devices may be used in association with the tunnel flap 96, including buttons, snaps, etc.

Figure 12:
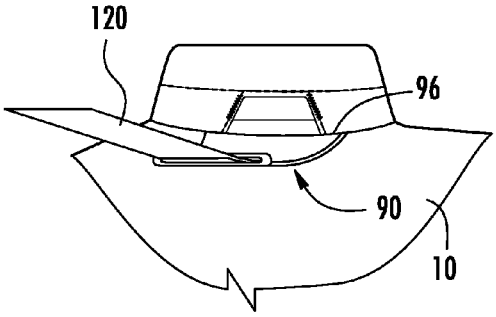
FIG. 12 shows a harness strap extending through the tunnel flap of FIG. 8.

In operation, a sportsman wearing a harness, such as a hunter wearing a tree stand harness inserts a tether 120, as illustrated in FIG. 12, or other harness strap through the tunnel flap 96 in order to join the harness inside of the garment 10 to a location outside of the garment 10 (such as the tree or the tree stand). This tether 120 may be easily inserted through the harness passage 90 at the time when the hunter dons the garment, and easily accessed at a time when the harness is needed for safety purposes. Accordingly, the harness may be used by the wearer without the need to remove the garment 10 or wear the harness over the garment 10. The shape and configuration of the tunnel flap effectively prevents the wearer from being exposed to the elements through the harness passage 90. Moreover, the shape and configuration of the tunnel flap 96 prevents moisture, such as rainwater, from running down the tether 120 and into the jacket. The tunnel flap 96 may be particularly effective at preventing moisture intrusion when the tunnel flap is comprised of an elastic material with a durable water repellent finish.

Additional Embodiments

Figure 13:
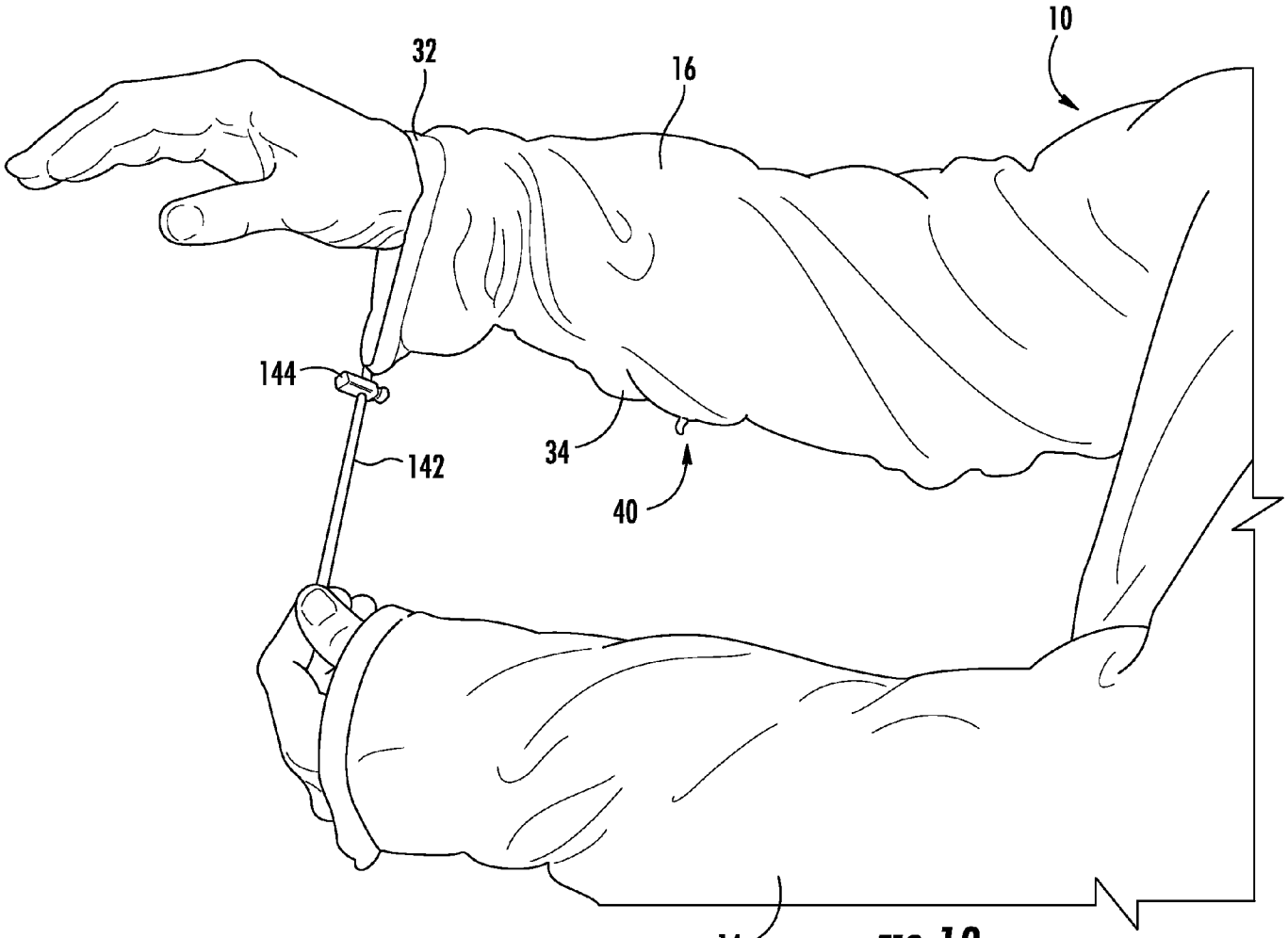
FIG. 13 shows an alternative embodiment of the garment of FIG. 1 further including an additional volume reduction arrangement on a wrist end of the sleeve.
Figure 14:
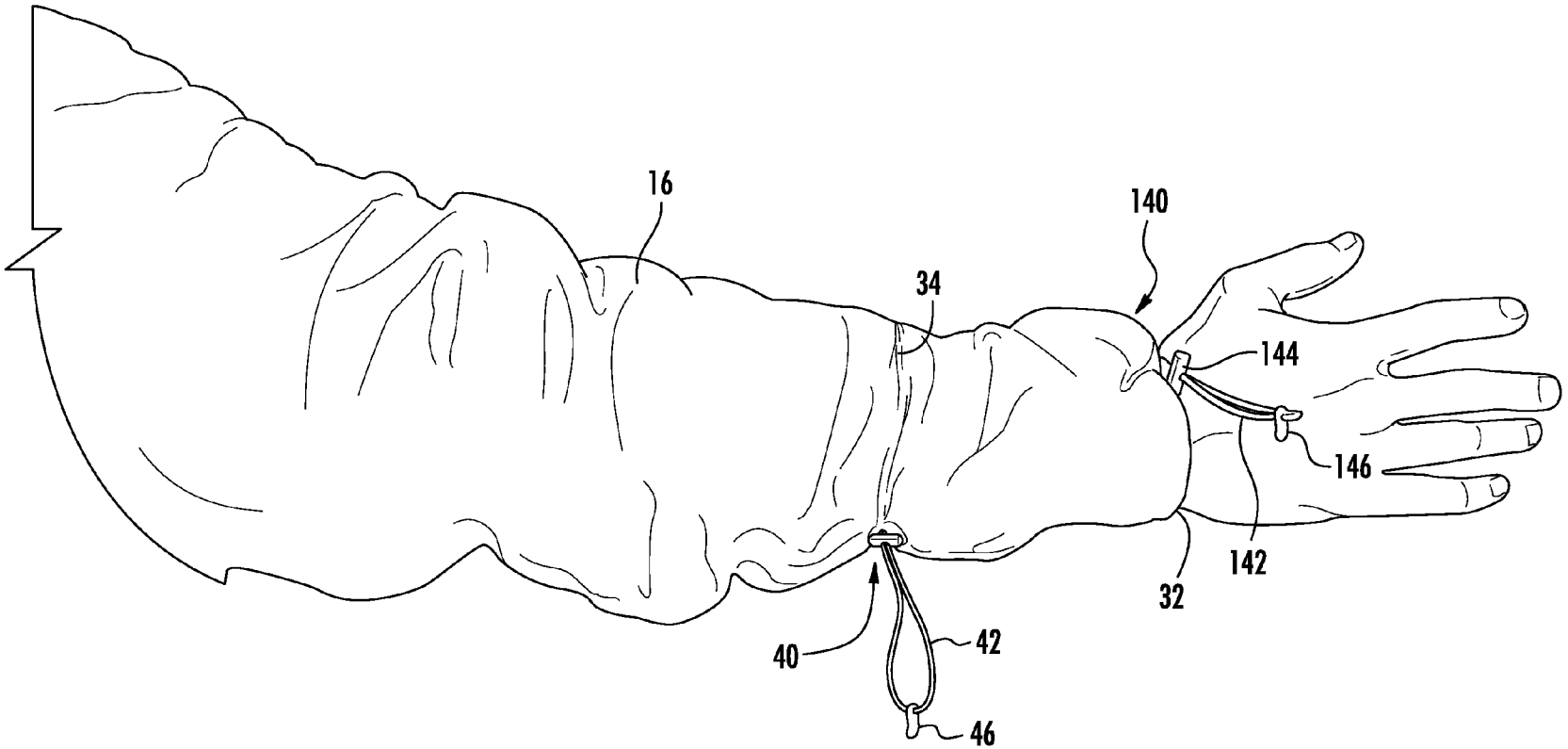
FIG. 14 shows the garment of FIG. 13 with the first volume reduction arrangement on the forearm portion of the sleeve in a stretched state and the additional volume reduction arrangement on the wrist end of the sleeve in a stretched state.

While various embodiments of the garment 10 have been described above with reference to FIGS. 1-12, it will be recognized by those of ordinary skill in the art that additional embodiments are possible. For example, FIGS. 13-14 show an additional embodiment that incorporates various features from the embodiment of FIGS. 1-12 while also including additional features. In, the embodiment of FIGS. 13-14, the garment 10 includes two volume adjustment arrangements on each sleeve 14 and 16, including the first volume adjustment arrangement 40 on the forearm portion 34 of the sleeve 14, 16 and a second volume adjustment arrangement 140 on the wrist end 32 of the sleeve 14, 16. The second volume adjustment arrangement 140 on the wrist end 32 is similar to the first volume adjustment arrangement 40 on the forearm portion 34. Accordingly, the second volume adjustment arrangement 140 includes a shock cord 142, a cord lock 144 coupled to the wrist end 32 by a tether, and a tab 146 to prevent the shock cord from being retracted completely through the cord lock 144. FIG. 14 shows the arm of the wearer with first volume adjustment arrangement 40 of the forearm portion 34 and the second volume adjustment arrangement 140 of the wrist end 32 in a stretched state with the shock cords 42 and 142 stretched on the garment 10 and extending away from the backhand side of the sleeve 16. As explained previously, in this stretched state, the excess fabric on the forearm portion 34 and wrist end 32 is urged in to the body of the wearer.

Another alternative embodiment is similar to the embodiment of FIGS. 13-14 and includes at least two volume adjustment arrangements on each the forearm portion 34 of each sleeve 14 and 16. These two volume adjustment arrangements include a first volume adjustment arrangement between the elbow and the middle of the forearm portion 34 of the sleeve 14, 16 (i.e., in an upper forearm position) and a second volume adjustment arrangement between the middle of the forearm portion 34 and the wrist end 32 of the sleeve 14, 16 (i.e., in a lower forearm position).

The foregoing detailed description of one or more embodiments of the sportsman's jacket have been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the embodiments contained herein.

What is claimed is:

1. A garment configured to be worn by a human, the garment comprising:

a torso portion including a shell with an inner side and an outer side; and a volume reduction arrangement provided on the torso portion, the volume reduction arrangement including a first strap, a second strap, a first strap adjustment member, and a second strap adjustment member, wherein a first portion of the first strap is coupled to the inner side of the shell on a left side of the torso portion, the first strap adjustment member is coupled to the shell on a right side of the torso portion, and a second portion of the first strap engages the first strap adjustment member on the right side of the torso portion, the first strap adjustment member positioned in a first pocket on a posterior of the right side of the torso portion, a first portion of the second strap is coupled to the inner side of the shell on a right side of the torso portion, the second strap adjustment member is coupled to the shell on a left side of the torso portion, and a second portion of the second strap engages the second strap adjustment member on the left side of the torso portion, the second strap adjustment member positioned in a second pocket on a posterior of the left side of the torso portion, and the first strap crosses the second strap on a posterior of the shell.

2. The garment of claim 1 wherein the first strap is a first elastic cord, the first strap adjustment member is a first cord lock, the second strap is a second elastic cord, and the second strap adjustment member is a second cord lock.

3. The garment of claim 1 wherein the first strap adjustment member is coupled to a first intermediate layer in the first pocket, the first intermediate layer including a hole with the first strap extending through the hole.

4. The garment of claim 1 wherein an outer layer of the shell has a bright, highly visible color scheme or a camouflaged color scheme.

5. The garment of claim 4 further including a harness passage extending from the posterior of the shell, the harness passage including a proximal end connected to the posterior of the shell and a distal end that is pivotable about the proximal end of the harness passage, the distal end further comprising a magnetic coupling member configured to releasably couple the distal end to the posterior of the shell.

6. The garment of claim 1 wherein the garment is a hunting jacket configured to be worn by a hunter with a harness, the shell of the torso portion including an anterior side and a posterior side with a bright highly visible color scheme or a camouflaged color scheme.

7. The garment of claim 6 further comprising a harness passage extending from an interior of the torso portion to an exterior of the torso portion, the harness passage including a proximal end connected to the posterior side and a distal end that is pivotable about the proximal end of the harness passage, the harness passage providing a channel configured to receive a harness strap extending from the proximal end to the distal end of the harness passage.

8. A hunting jacket configured to be worn by a hunter, the jacket comprising:

a torso portion including an inner side and an outer side; and a volume reduction arrangement provided on the torso portion, the volume reduction arrangement including:

a first strap with a first portion of the first strap coupled to a left side of the torso portion;

a second strap with a first portion of the second strap coupled to a right side of the torso portion, the first strap crossing the second strap at a posterior of the torso portion;

a first strap adjustment member coupled to the right side of the torso portion with a second portion of the first strap engaging the first strap adjustment member on the right side of the torso portion, the first strap adjustment member positioned in a first pocket on a right posterior side of the torso portion; and a second strap adjustment member coupled to the left side of the torso portion with a second portion of the second strap engaging the second strap adjustment member on the left side of the torso portion, the second strap adjustment member positioned in a second pocket on a left posterior side of the torso portion.

9. The hunting jacket of claim 8 wherein the first strap is a first elastic cord, the first strap adjustment member is a first cord lock, the second strap is a second elastic cord, and the second strap adjustment member is a second cord lock.

10. The hunting jacket of claim 8 wherein the first strap adjustment member is coupled to a first intermediate layer in the first pocket, the first intermediate layer including a hole with the first strap extending through the hole.

11. The hunting jacket of claim 8 wherein the outer side of the torso portion includes a bright, highly visible color scheme or a camouflaged color scheme.

12. The hunting jacket of claim 8 further including a harness passage extending from the posterior of the torso portion, the harness passage including a proximal end connected to the posterior of the torso portion and a distal end that is pivotable about the proximal end of the harness passage, the distal end further comprising a magnetic coupling member configured to releasably couple the distal end to the posterior of the torso portion.

13. The hunting jacket of claim 8 wherein the first strap crisscrosses the second strap at the posterior of the torso portion.

14. The hunting jacket of claim 13 wherein the first strap is positioned within a first passage and the second strap is positioned within a second passage, and the first passage crisscrosses the second passage.

15. The hunting jacket of claim 14 wherein the first passage and the second passage extend between the inner side and the outer side of the torso portion.

16. The hunting jacket of claim 15 wherein the first passage crisscrosses the second passage at a center of the posterior of the torso portion.

17. The garment of claim 1 wherein the first strap crisscrosses the second strap at the posterior of the torso portion.

18. The garment of claim 17 wherein the first strap is positioned within a first passage and the second strap is positioned within a second passage, and the first passage crisscrosses the second passage.

19. The garment of claim 18 wherein the first passage and the second passage extend along the inner side of the shell.

20. The garment of claim 19 wherein the first passage crisscrosses the second passage at a center of the posterior of the shell.

* * * * *